US011473311B1

(12) United States Patent
Fitzgerald

(10) Patent No.: US 11,473,311 B1
(45) Date of Patent: Oct. 18, 2022

(54) LOUVER ROOF STRUCTURE

(71) Applicant: Renaissance Patio Products Inc., Doral, FL (US)

(72) Inventor: Lisa Fitzgerald, Leesburg, FL (US)

(73) Assignee: RENAISSANCE PATIO PRODUCTS INC., Doral, FL (US)

( * ) Notice: Subject to any disclaimer, the term of this patent is extended or adjusted under 35 U.S.C. 154(b) by 0 days.

(21) Appl. No.: 17/566,791

(22) Filed: Dec. 31, 2021

(51) Int. Cl.
*E04F 10/10* (2006.01)
*E04B 7/02* (2006.01)

(52) U.S. Cl.
CPC ..... *E04F 10/10* (2013.01); *E04B 7/02* (2013.01)

(58) Field of Classification Search
CPC ..... E04F 10/10; E04B 7/02; E04B 7/163
USPC ..... 52/95
See application file for complete search history.

(56) References Cited

U.S. PATENT DOCUMENTS

| | | | | |
|---|---|---|---|---|
| 5,733,036 | A * | 3/1998 | Montgomery | F21V 11/04 362/325 |
| 8,756,873 | B1 * | 6/2014 | Hire | E04F 10/10 49/82.1 |
| 10,851,544 | B1 * | 12/2020 | Volin | E04B 7/163 |
| 10,988,926 | B2 * | 4/2021 | Mitchell | E04B 7/163 |
| 2019/0338528 | A1 * | 11/2019 | Torman | E04F 10/10 |
| 2020/0354962 | A1 * | 11/2020 | Whytlaw | E06B 7/096 |
| 2020/0370299 | A1 * | 11/2020 | Shan | E04F 10/10 |
| 2021/0062505 | A1 * | 3/2021 | Elmore | E04F 10/10 |
| 2021/0214948 | A1 * | 7/2021 | Jackson | E04D 13/0354 |
| 2021/0332587 | A1 * | 10/2021 | Geriavenko | E04F 10/10 |

FOREIGN PATENT DOCUMENTS

| | | | | |
|---|---|---|---|---|
| CN | 111946104 | A * | 11/2020 | E04F 10/10 |
| DE | 202021000335 | U1 * | 4/2021 | |
| DE | 202021102781 | U1 * | 12/2021 | |

* cited by examiner

*Primary Examiner* — Beth A Stephan
(74) *Attorney, Agent, or Firm* — Shumaker, Loop & Kendrick, LLP

(57) ABSTRACT

A louver roof system having a simplified assembly and installation methods. The louver roof system is constructed with multi-functional mechanical components by means of pre-molded parts to reduce skilled installation time. Water drainage path is an integral part of the main structural assembly.

24 Claims, 12 Drawing Sheets

27

LOUVER ROOF STRUCTURE

TECHNICAL FIELD

The present invention relates generally to the field of patio roofs, and more particularly, to easy to assemble and disassemble freestanding louver roofs.

BACKGROUND

Louver roofs have been commercially available for many years. These roofs are typically used on patios or outside event areas to allow sunlight on clear days and dryness on rainy days. This is accomplished by moving the louvers from an open to shut position manually or motor-driven by means of sensors and/or control panel switches. These lover roofs are constructed from a plurality of rotatable louvers, linked together by mechanical links and hinges that require skilled workers to install in the field. Alignment of these parts are critical to the reliability and longevity of the louvers' ability to move freely from the open to closed position. The assembly of super structure that houses and supports the lovers are also critical to the smooth mechanical action of the assembly. Water sealing and water removal from the structure is also challenging with the multitude of parts requiring skilled and experienced installers.

SUMMARY

Thus, a need exists to provide an easier installation alternative that overcomes the above-mentioned problems. Thus, specifically disclosed is a louver roof system that provides easier field installation and mechanical construction that uses low tolerance assembles with fewer parts.

The louver drive system is comprised of one single cable to move the louvers from an open to closed position, thereby eliminating linkages and hinges used on current designs. In this embodiment, the cable is actuated by means of a linear actuator. In other embodiments, the cable can be actuated by a rotational actuator (motor pulley) or a hand crank. The cable is wrapped around a drum, an integral part of the plastic end cap. This end cap is molded with weather-resistant plastic, one for each end of each louver. The cable is routed to the drive module, located in one of the structural posts, through cable sheaths similar to a bicycle brake cable. This drive module contains the linear actuator to drive the cable, thereby opening or closing the louvers. To assemble, the cable is tensioned for the entire assembly. The louvers are manually positioned to the correct position and locked into place, relative to the cable, by means of a clamping screw located on each louver end cap, thereby eliminating precision parts and critical installation techniques used on current designs.

In this embodiment, the main structure is composed of four posts, in a rectangular pattern, connected at the top by four beams. In other embodiments there may be two posts on one side and on the other side, beams attached to an existing structure. These beams provide the load-bearing structure for the roof louvers. The louvers are connected to the beams by hangers on each end of the louver assemblies. These hangers are molded with a weather resistant plastic. The hanger uses a cup-and-ball type bearing arrangement. The cup is an integral part of the hanger, and the ball is part of the louver end-cap assembly. This allows large alignment tolerance in this bearing, which provides easier installation of the louvers to the main structure. In this embodiment, the louvers are level to the ground plane. In other embodiments, the entire roof assembly may be at an angle, for water flow and/or aesthetics, relative to the ground plane. In this case, the bearing arrangement allows this angle to be achieved while all the main structure components are parallel to the ground.

Drainage is provided using a gutter, as an integral part of the beam extrusion, to channel water to the interior volume of the posts, thereby using the post as downspouts. Louver assemblies have drainage channels that empty into the beam gutters. A splash guard, an integral part of each louver end cap, prevents slash-back as water enters the beam gutters. An opening at ground level on the post allowing water to escape. An aluminum cover is attached to the top of the beams to keep leaves and debris out of the beam gutters. This cover also acts as a UV blocker to increase the life of the molded plastic parts in the assembly.

Control of louver actuation is provided by switches on a control panel and/or remote radio control that provides power to the linear actuator. An "H" bridge switch allows the linear actuator to run in two directions, dependent on the switch activated by the user. All control circuits are integrated in one control module located in the drive module.

In certain aspects, disclosed is a louver roof structure that comprises: (a) a plurality of louvers positioned within an upper portion of a frame and that are actuatable from an open position to a closed position, the plurality of louvers forms a plurality of channels configured to direct water internally within the frame and out of the louver roof structure when the plurality of louvers are in the closed position; and the frame including: vertically oriented posts, with each post having a first end and second end that are spaced apart from one another with the first end configured to directly contact a surface underneath the louver roof structure and support the louver roof structure thereon, a plurality of crossbeams, with at least one cross beam positioned between and directly connected to the second end of two vertically oriented posts, wherein: the frame includes internal portions configured to receive water from the plurality of channels formed by the plurality of louvers when in the closed position and direct water internally within the louver roof structure through at least one crossbeam of the frame internally into at least one vertically oriented post of the frame and out of the louver roof structure via an opening positioned on the first end of the at least one vertically oriented post.

In certain aspects, the louver roof structure further comprises a debris cover positioned above the upper portion of the frame that is configured to prevent and/or reduce debris from entering into the plurality of louvers to maintain operability of the plurality of louvers.

In certain aspects, each louver of the plurality of louvers is connected to one another and configured to actuate in concert from the open position to the closed position and vice versa.

In certain aspects, each louver of the plurality of louvers includes a drum that is operably connected to a cable and an actuator.

In certain aspects, the actuator is configured to actuate the cable thereby concurrently moving each louver of the plurality of louvers from the open position to the closed position and vice versa.

In certain aspects, the actuator is internally positioned and concealed within at least one of the vertically oriented posts.

In certain aspects, each crossbeam of the frame and each vertically oriented post of the frame includes portions internally positioned within the louver roof structure that are configured to receive water from the plurality of channels formed by the plurality of louvers when in the closed position that direct water internally within the louver roof structure through at least one crossbeam of the frame internally into at least one vertically oriented post of the frame and out of the louver roof structure via an opening positioned on the first end of the at least one vertically oriented post.

In certain aspects, each crossbeam comprises a gutter formed internally within the louver roof structure on an inner portion of the crossbeam that is configured to receive water from the plurality of channels formed by the plurality of louvers when in a closed position and each vertically oriented post comprises a downspout that is in fluid communication with at least one gutter formed on the inner portion of at least one of the crossbeam and is configured to direct water through the vertically oriented posts and out of openings positioned on the first end of each vertically oriented post.

In certain aspects, the louver roof structure includes at least two gutters formed internally within the louver roof structure on an inner portion of two separate crossbeams and the louver roof structure further includes at least two downspouts, with each downspout formed in two separate vertically oriented posts. In this aspect, the at least two gutters are in fluid communication with at least one of the two downspouts to direct water from the water channels formed in the closed louvers into the downspouts and out of the louver roof structure.

In certain aspects, the louver roof structure includes at least four gutters formed internally within the louver roof structure on an inner portion of four separate crossbeams and the louver roof structure further includes at least two downspouts, with each downspout formed in two separate vertically oriented posts. In this aspect, the at least four gutters are in fluid communication with at least one of the two downspouts to direct water from the water channels formed in the closed louvers into the downspouts and out of the louver roof structure. In certain aspects, the louver roof structure includes at least three gutters formed internally within the louver roof structure on an inner portion of two separate crossbeams and the louver roof structure further includes at least three downspouts, with each downspout formed in three separate vertically oriented posts. In this aspect, the at least three gutters are in fluid communication with at least one of the three downspouts to direct water from the water channels formed in the closed louvers into the downspouts and out of the louver roof structure. In certain aspects, the louver roof structure includes at least four gutters formed internally within the louver roof structure on an inner portion of four separate crossbeams and the louver roof structure further includes at least four downspouts, with each downspout formed in four separate vertically oriented posts. In this aspect, the at least four gutters are in fluid communication with at least one of the four downspouts to direct water from the water channels formed in the closed louvers into the downspouts and out of the louver roof structure. In any of the aspects above, it is preferable that an opening (or aperture) be positioned within the first end of any vertically oriented post having a downspout therein to further facilitate water flow out and away from the louver roof structure.

In certain aspects, the louver roof structure further comprises connecting members that connect each louver to the frame that are configured for independent linear movement of each louver relative to one another during and post-installation of the louver roof structure.

In certain aspects, the connecting members comprises a cup and ball bearing arrangement.

In certain aspects, the connecting members do not allow for independent rotational movement of each louver relative to one another.

In certain aspects, the internal portions are configured to receive water comprise a gutter formed on an inner portion of the at least one crossbeam and a downspout formed within the at least one vertically oriented post that is in fluid communication with both the gutter formed on an inner portion of the at least one crossbeam and the opening positioned on the first end of the at least one vertically oriented post. In certain aspects, the louver roof structure further comprises connecting members that connect each louver to the frame that are configured for independent linear movement of each louver relative to one another during and post-installation of the louver roof structure.

Also disclosed is a louver roof assembly comprising: (a) a plurality of louvers configured for positioning within an upper portion of a frame that are actuatable from an open position to a closed position, the plurality of louvers form a plurality of channels are configured to direct water internally within the frame and out of the louver roof structure when the plurality of louvers are in the closed position; and (b) the frame including: (i) vertically oriented posts, with each post having a first end and second end that are spaced apart from one another with the first end configured to directly contact a surface underneath the louver roof structure and support the louver roof structure thereon, (ii) a plurality of crossbeams, with each cross beam configured for positioning between and directly connected to the second end of two vertically oriented posts, wherein: the frame includes internal portions configured to receive water from the plurality of channels formed by the plurality of louvers when in the closed position and direct water through at least one crossbeam of the frame internally into at least one vertically oriented post of the frame and out of the louver roof structure via an opening positioned on the first end of the at least one vertically oriented post.

In certain aspects, the louver roof assembly further comprises a debris cover that is configured for positioning above the upper portion of the frame to prevent and/or reduce debris from entering into the plurality of louvers to maintain operability of the plurality of louvers when the louver roof assembly is assembled. In this aspect, each louver of the plurality louvers is connected to one another and are configured to actuate in concert from an open position to the closed position and vice versa. In this aspect, the internal portions are configured to receive water comprise a gutter formed on an inner portion of the at least one crossbeam and a downspout formed within the at least one vertically oriented post that is in fluid communication with both the gutter formed on an inner portion of the at least one crossbeam and the opening positioned on the first end of the at least one vertically oriented post.

In certain aspects, the louver roof assembly further comprises connecting members configured to connect each louver to the frame and for independent linear movement of each louver relative to one another during and post-installation of the louver roof structure. In certain aspects, the connecting members comprises a cup and ball bearing arrangement.

Additional features, aspects and advantages of the invention will be set forth in the detailed description that follows, and in part will be readily apparent to those skilled in the art from that description or recognized by practicing the invention as described herein. It should be understood that both the foregoing general description and the following detailed description present various embodiments of the invention and are intended to provide an overview or framework for understanding the nature and character of the invention as it is claimed. The accompanying drawings are included to provide a further understanding of the invention, are incorporated in, and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully, hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete and will fully convey the scope of the invention and enable one of ordinary skill in the art to make, use and practice the invention. Like reference numbers refer to like elements throughout the various drawings.

The present invention will now be described more fully hereinafter with reference to the accompanying drawings in which exemplary embodiments of the invention are shown. The exemplary embodiments are provided so that this disclosure will be both thorough and complete and will fully convey the scope of the invention and enable one of ordinary skill in the art to make, use and practice the invention. Like reference numbers refer to like elements throughout the various drawings. The louver roofs, louver roof structures, and louver roof structures disclosed herein may vary in size and dimension but are preferably used for outdoor purposes (e.g., patios).

Figure 1:
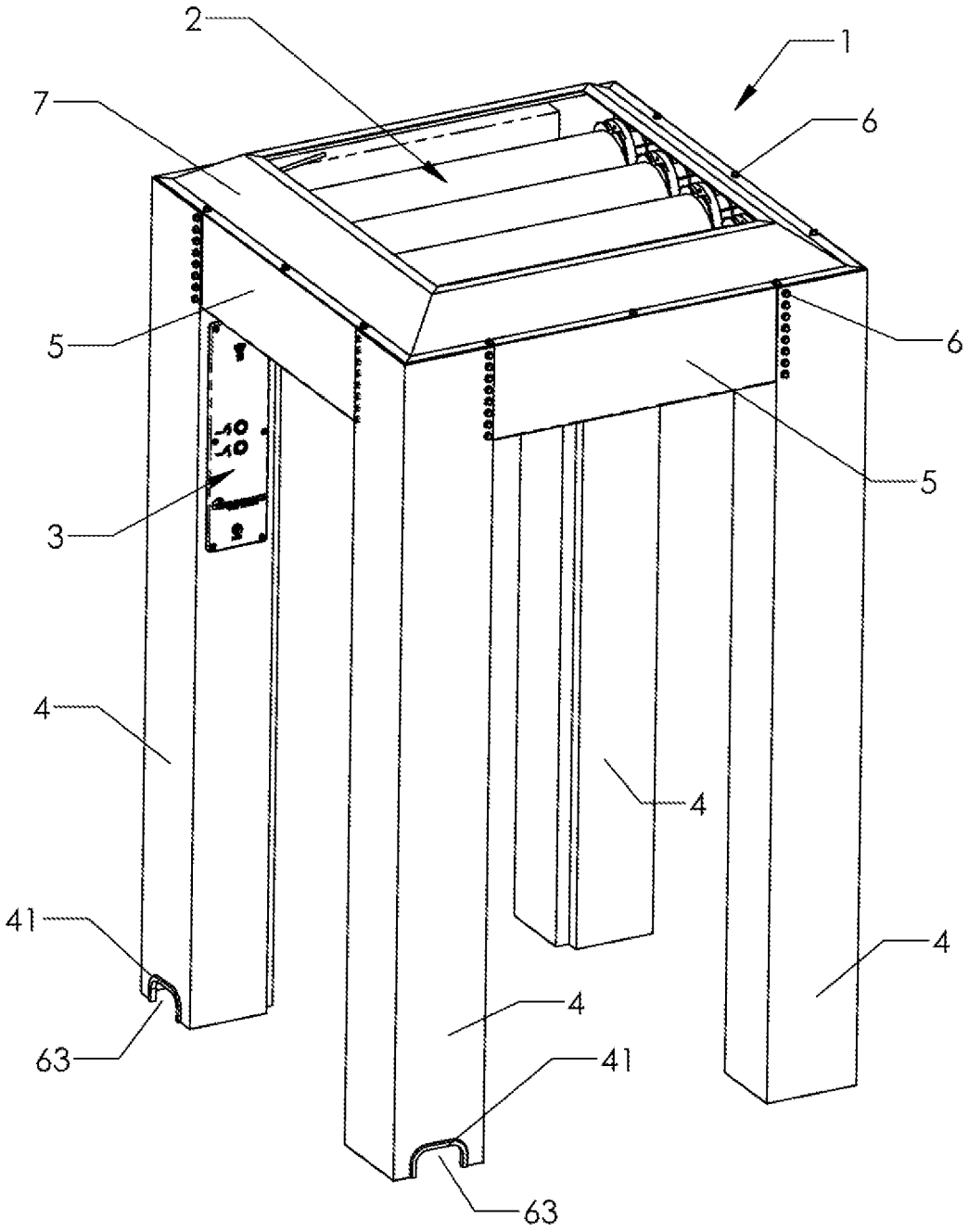
FIG. 1 is an Isometric view of the louver roof assemblies.
Figure 2:
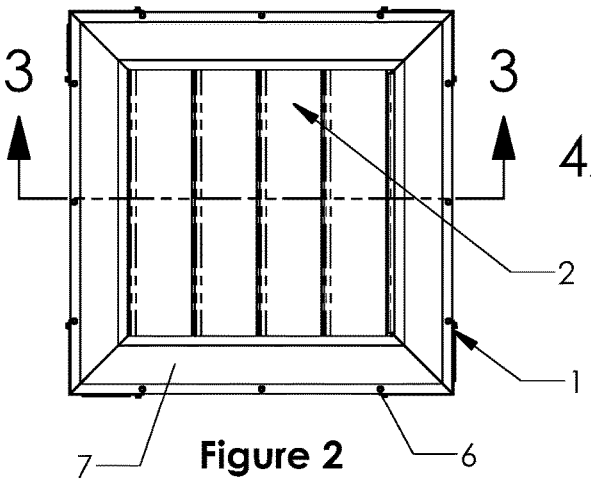
FIG. 2 is a Top view of the louver roof assemblies.
Figure 3:
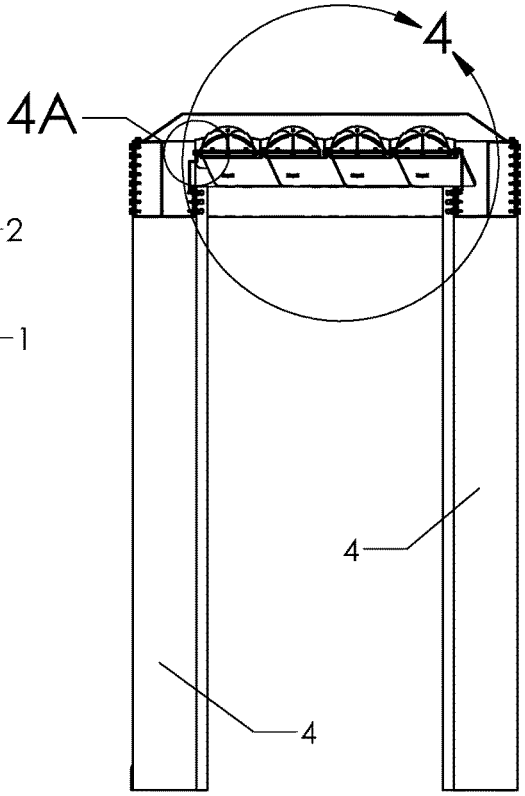
FIG. 3 is a Section view of FIG. 2.
Figure 4A:
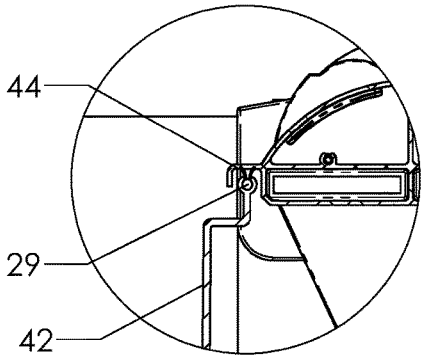
FIG. 4A is another magnified Detail View of FIG. 3.
Figure 4:
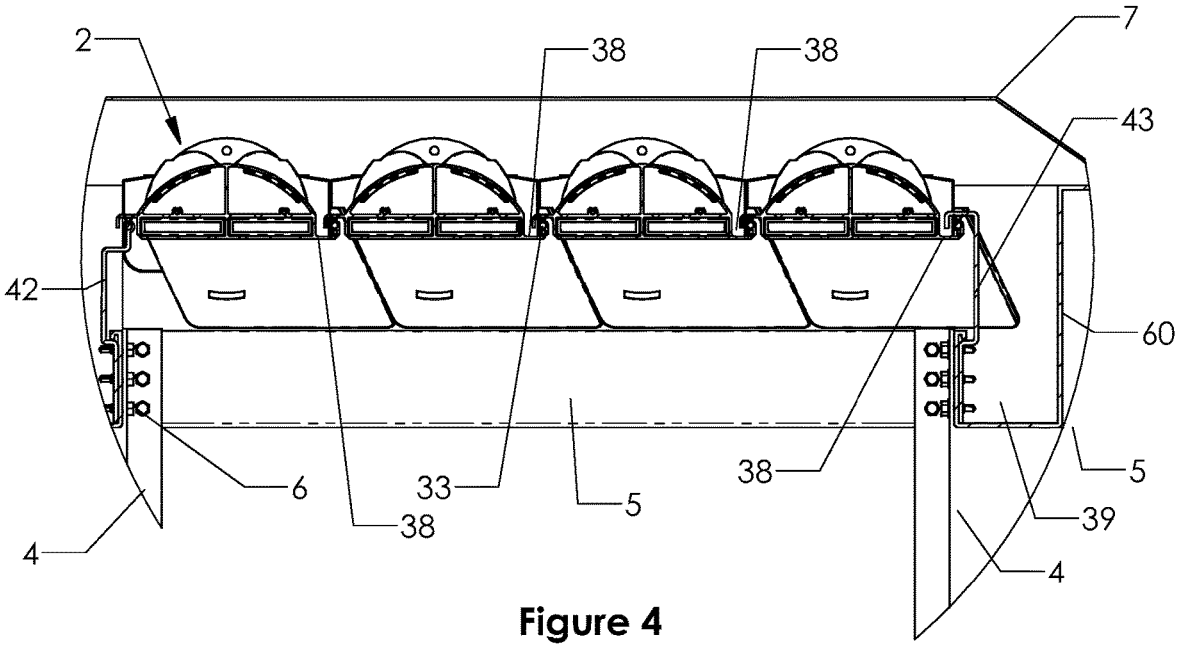
FIG. 4 is a magnified Detail View of FIG. 3.
Figure 5:
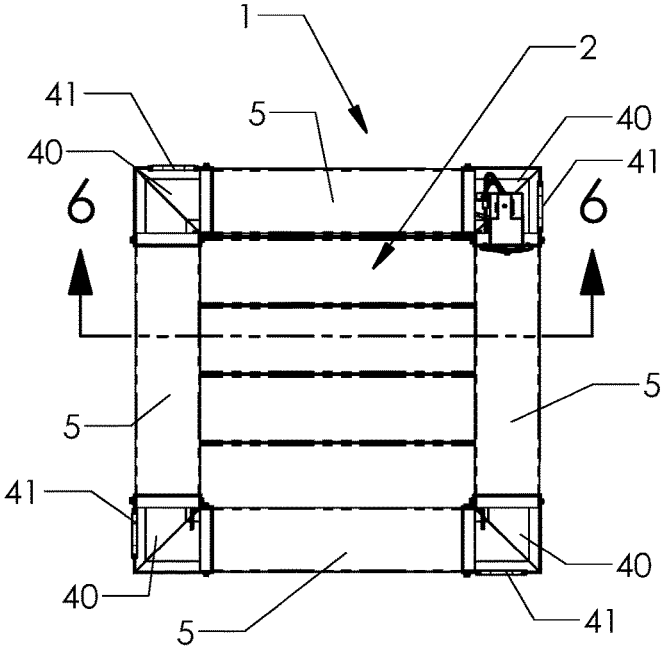
FIG. 5 is a Bottom view of the louver roof assemblies.
Figure 6:
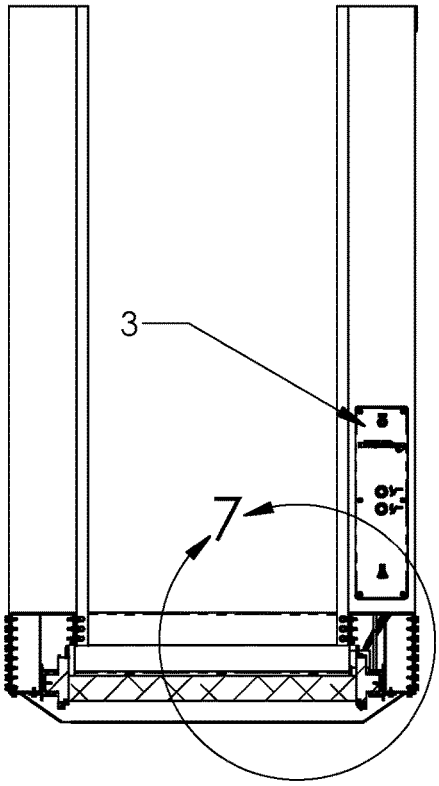
FIG. 6 is a Section view of FIG. 5.

Referring to FIG. 1 the louver roof is comprised of the main structure 1, a plurality of louver assemblies 2 and drive module assembly 3.

Referring to FIGS. 1, 2, 3, 4, 5, 6, 7, 27, 28, 29, 30 and 31, main structure 1 is comprised of 4 (four) posts 4, constructed from aluminum extrusions, arranged vertically in a rectangular pattern, and 4 (four) beams 5, constructed from aluminum extrusions, located coincident to the top surface of the posts. The 4 (four) posts 4 are attached to the 4 (four) horizontal beams 5 by means of a plurality of self-tapping screws 6. This forms a rigid box structure if lower posts are connected to a ground substrate. One of the posts 4 provides the mounting substrate for the drive module 3. The top surface of the 4 (four) beams 5 provide surface for mounting for the 4 (four) debris/UV covers 7 by means of a plurality of self-tapping screws 6. These covers are installed to keep leaves and debris out of the louver mechanism and provide UV shielding for plastic parts used in the assembly.

Referring to FIGS. 1, 2, 3, 4, 5, 6, 7 and 26, beam 5 provides the structural mounting surface for a plurality of louver assemblies 2 by means of hangers 9 secured by self-tapping screws 6. Beam 5 is the lateral rectangular structural member formed by structural wall 60, an integral part of the beam 5 extrusion. An appendage on beam 5 creates gutter 39 to channel water from the louver assemblies 2, by means of water channel 38, to the downspout 40, the internal volume of the post 4. The gutter 39 appendage adds additional beam strength to beam 5. A decorative bezel 41 is captured in an aperture 63 on each post 4 at ground level. These apertures 63 drain the downspouts 40.

Referring to FIGS. 4, 10, 11, 12, 13, 14, and 15, louver assembly 2 is comprised of the louver body 32, an aluminum extrusion, left louver cap 25, a molded plastic part, and right louver cap 26, a molded plastic part. The louver caps are affixed to the louver body 32 by means of thread-forming screws 30. Bearing 8 is attached to bearing boss 36 of each end cap by means of screw 31. A clamp screw 14 and clamp screw nut 15 is installed in the right end cap 26. In other embodiments, these screws may be installed in the left end cap 25. A water channel 38, an integral part of louver body 32, runs along the longitudinal axis of louver body 32 to drain water through the left end cap 25 and right end cap 26 and into gutter 39, an integral part of beam 5. Left and right end caps include a splashguard 35, an integral part of each end cap. Louver seal 33, an elastomer extrusion, is press fit into the louver seal channel 34, an integral part of louver body 32. This seal runs along the longitudinal axis of louver body 32 and seals against sealing channel 37 on the adjacent louver when louvers are in the closed position.

Figure 7:
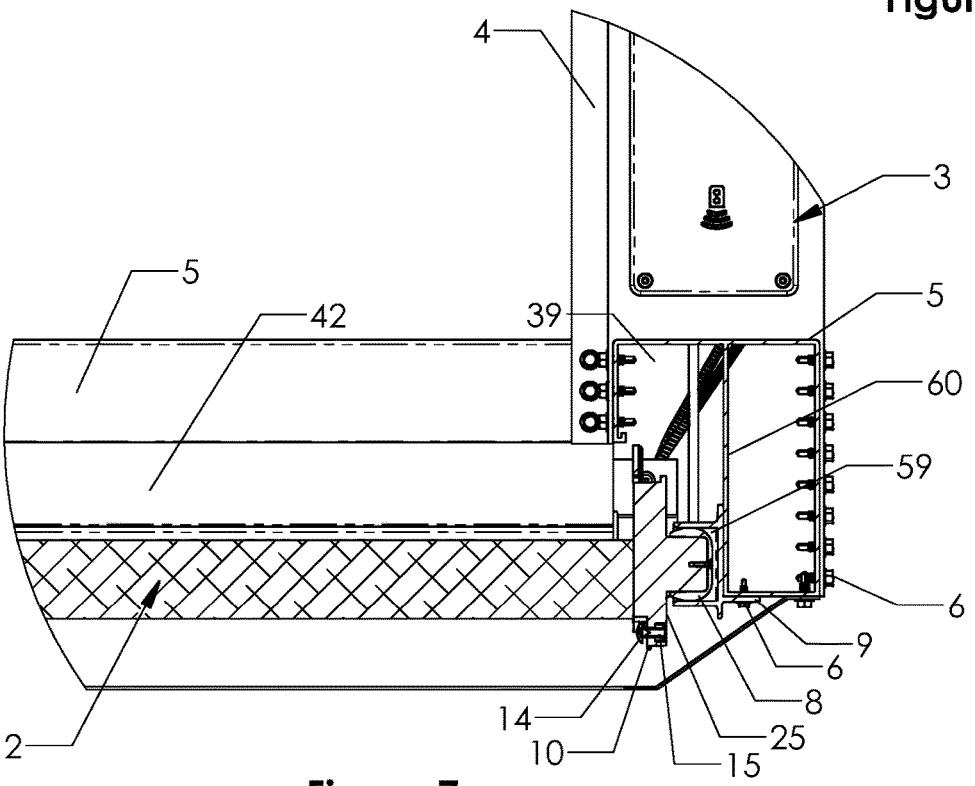
FIG. 7 is a magnified Detail view of FIG. 6.
Figure 26:
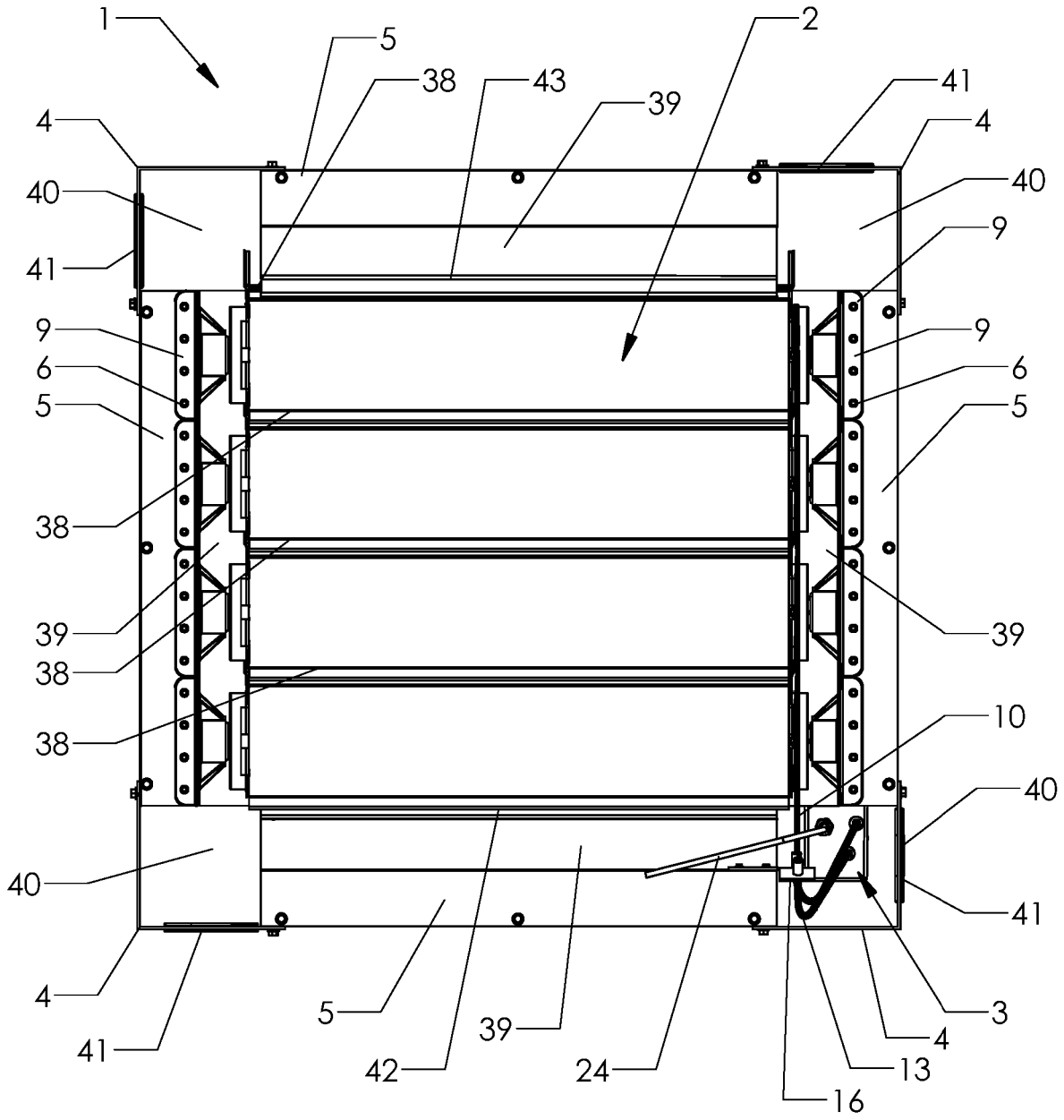
FIG. 26 is a Top view of the louver roof assemblies with parts removed for clarity.
Figure 27:
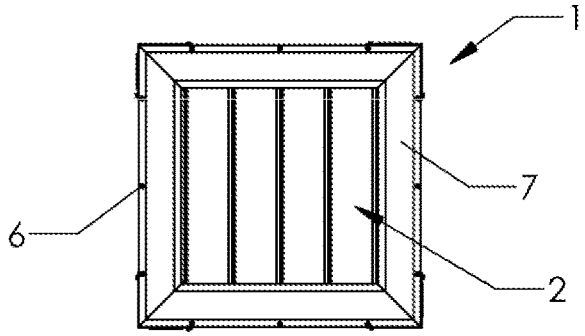
FIG. 27 is another Top view of the louver roof assemblies.
Figure 28:
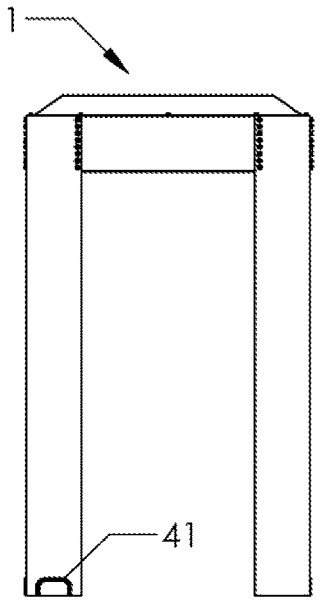
FIG. 28 is a Left view of the louver roof assemblies.
Figure 29:
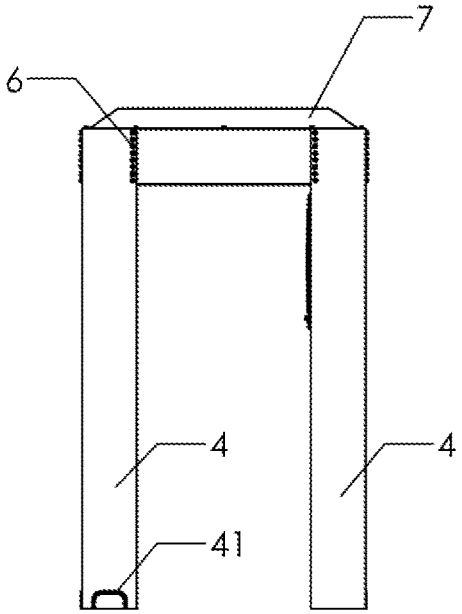
FIG. 29 is a Front view of the louver roof assemblies.
Figure 30:
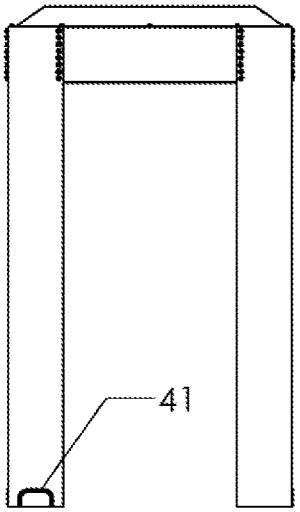
FIG. 30 is a Right view of the louver roof assemblies.
Figure 31:
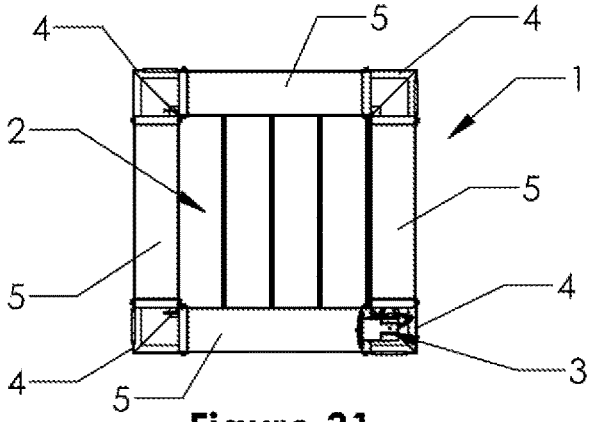
FIG. 31 is another Bottom view of the louver roof assemblies.

Referring to FIGS. 7 and 26, louver assembly 2 is captured and constrained in the main structure 1 by bearing 8, a part of louver assembly 2, inserted into the bearing receiver 59, an integral part of hanger 9. This bearing 8 and bearing receiver 59 design allows 15 degrees of angular freedom to allow slight misalignment between each end of the louver assembly 2 and allows the entire louver roof to be installed at an angle relative to beam 5 for water flow and/or aesthetics.

Figure 9:
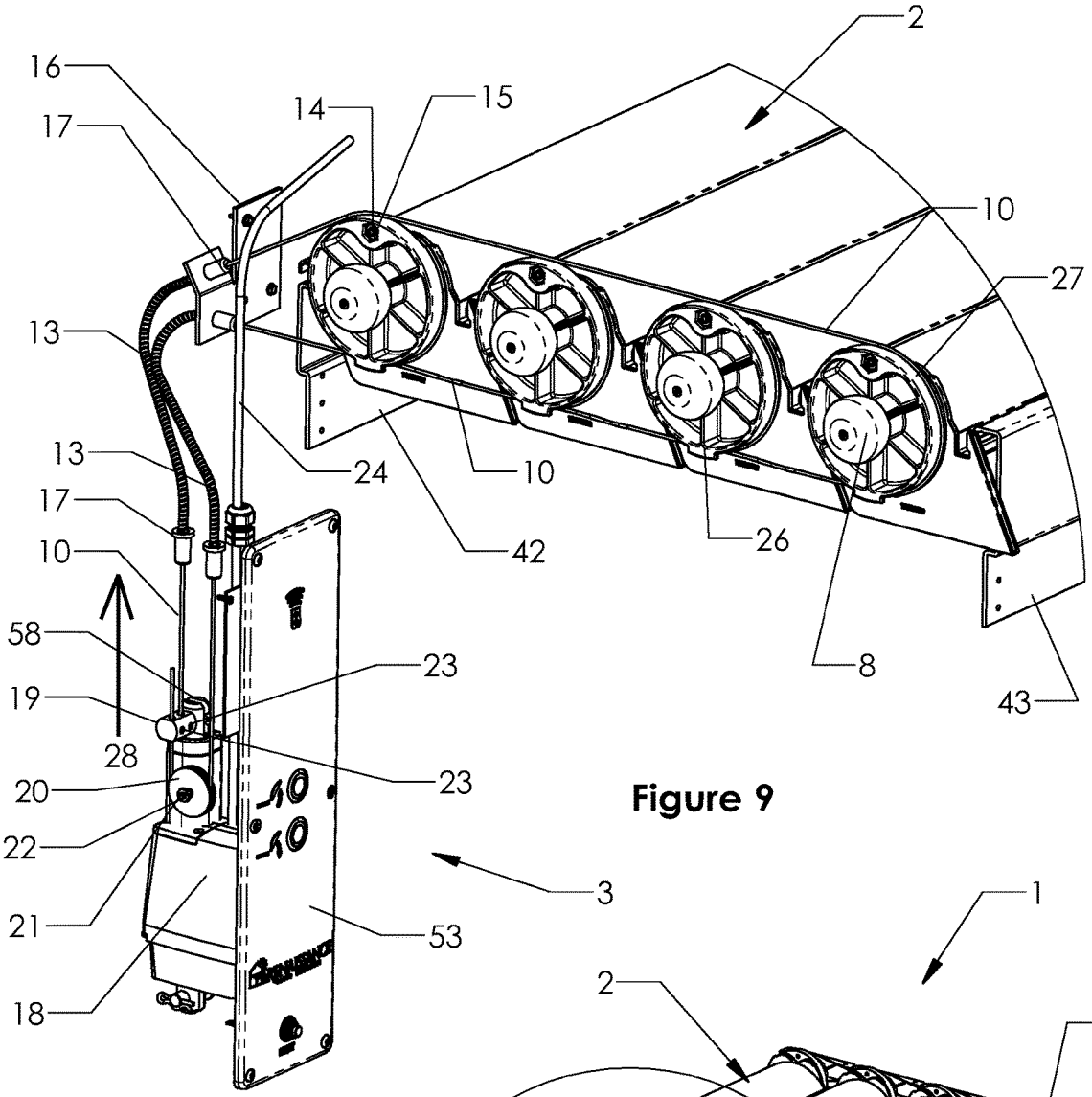
FIG. 9 is a magnified Detail view of FIG. 8.
Figure 8:
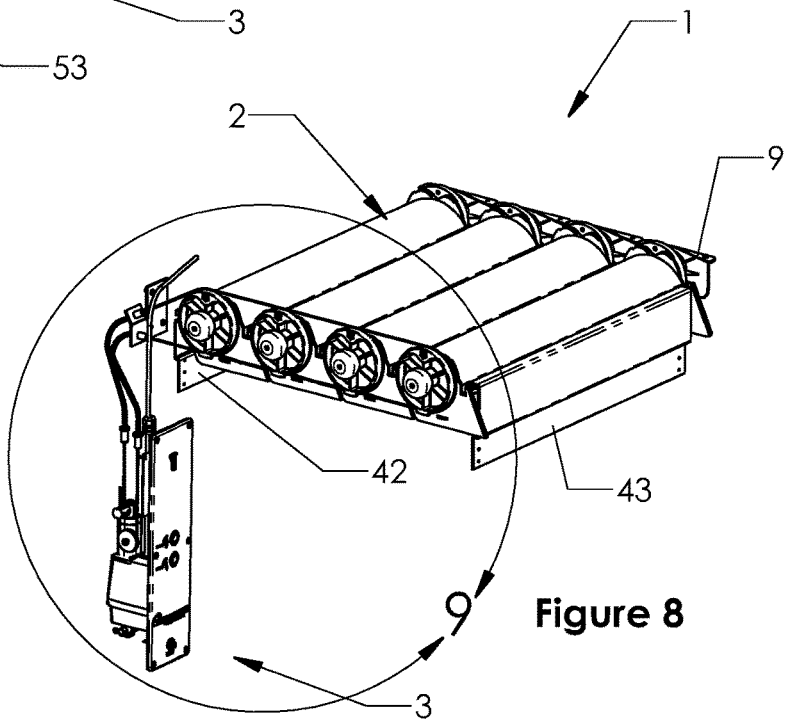
FIG. 8 is an Isometric view of the louver roof assemblies with parts removed for clarity.
Figure 10:
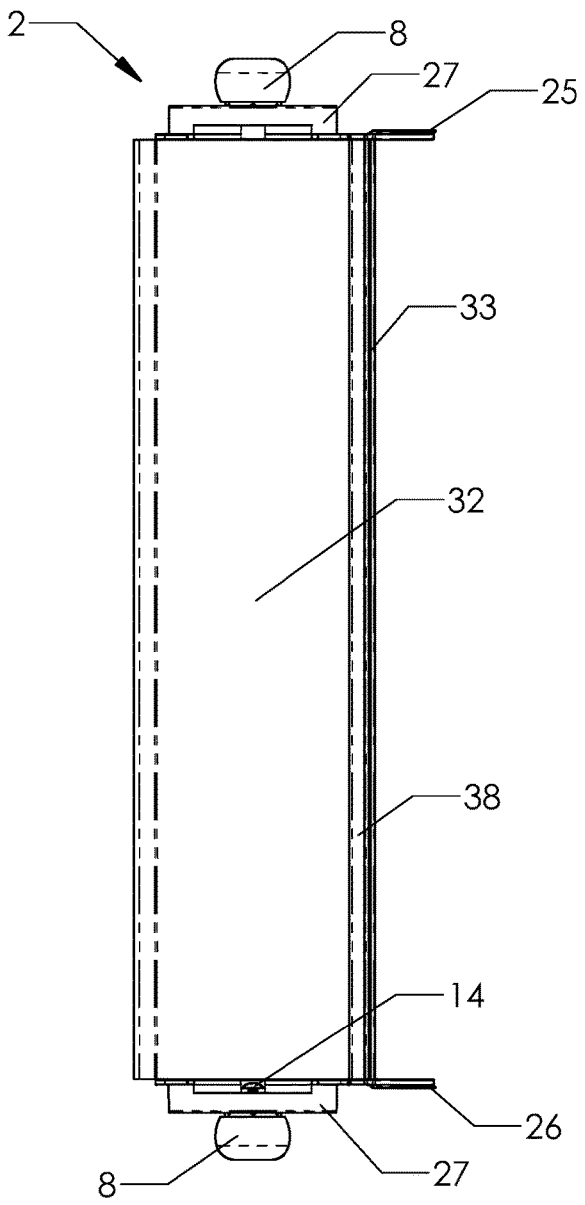
FIG. 10 is a Top view of the louver assembly.
Figure 11:
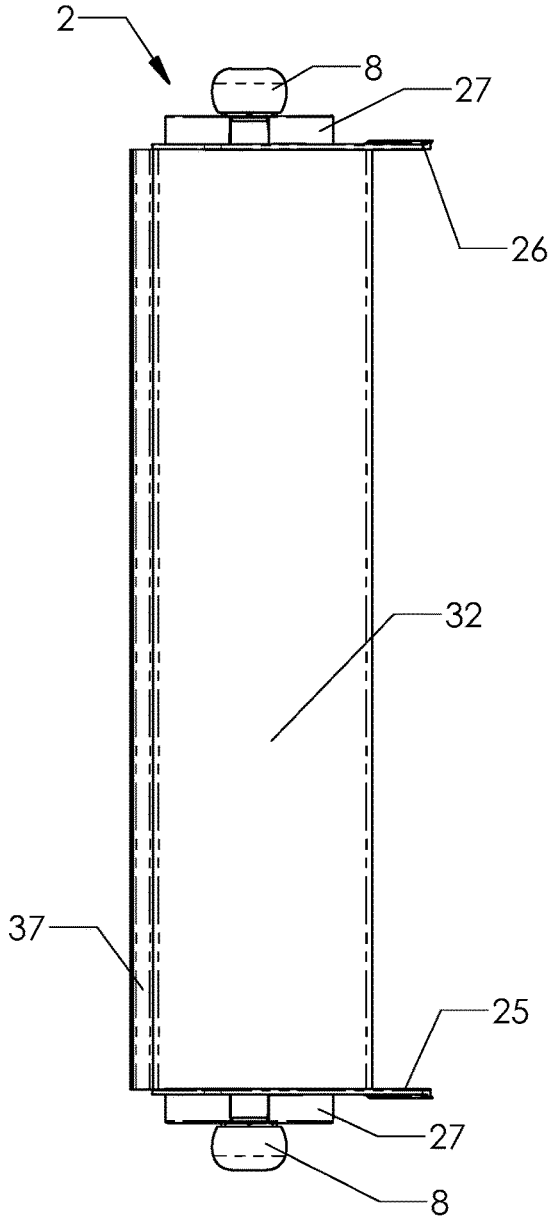
FIG. 11 is a Bottom view of the louver assembly.
Figure 12:
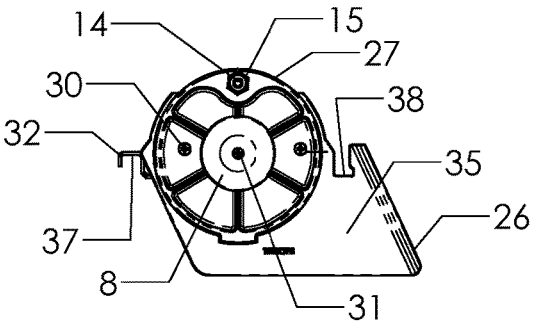
FIG. 12 is a Right view of the louver assembly.
Figure 13:
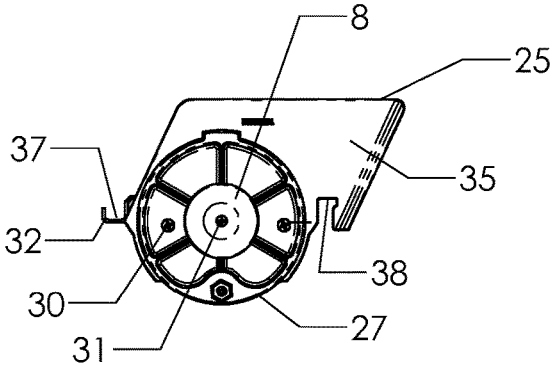
FIG. 13 is a Left view of the louver assembly.
Figure 14:
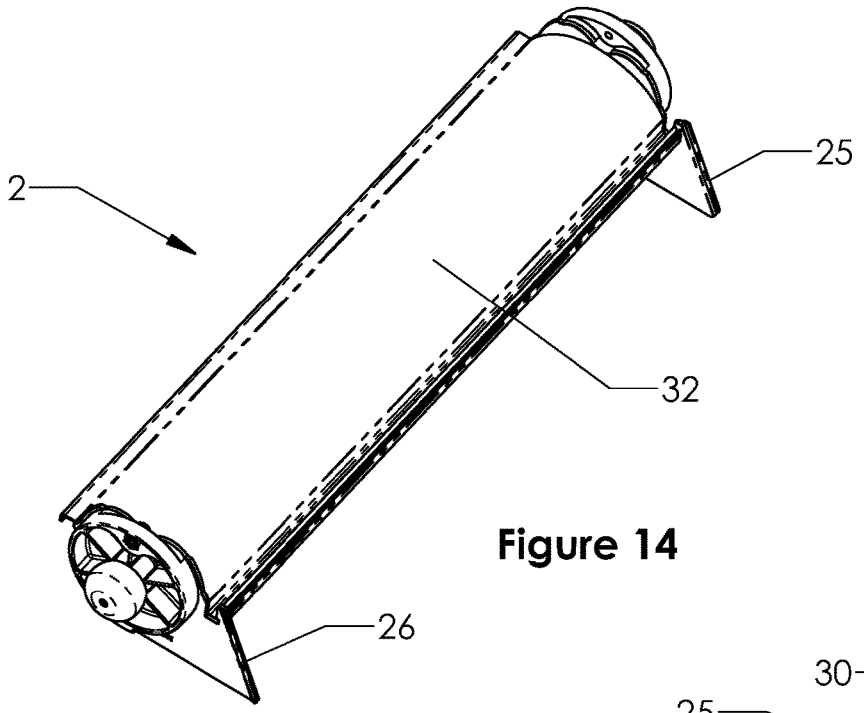
FIG. 14 is an Isometric view of the louver assembly.
Figure 15:
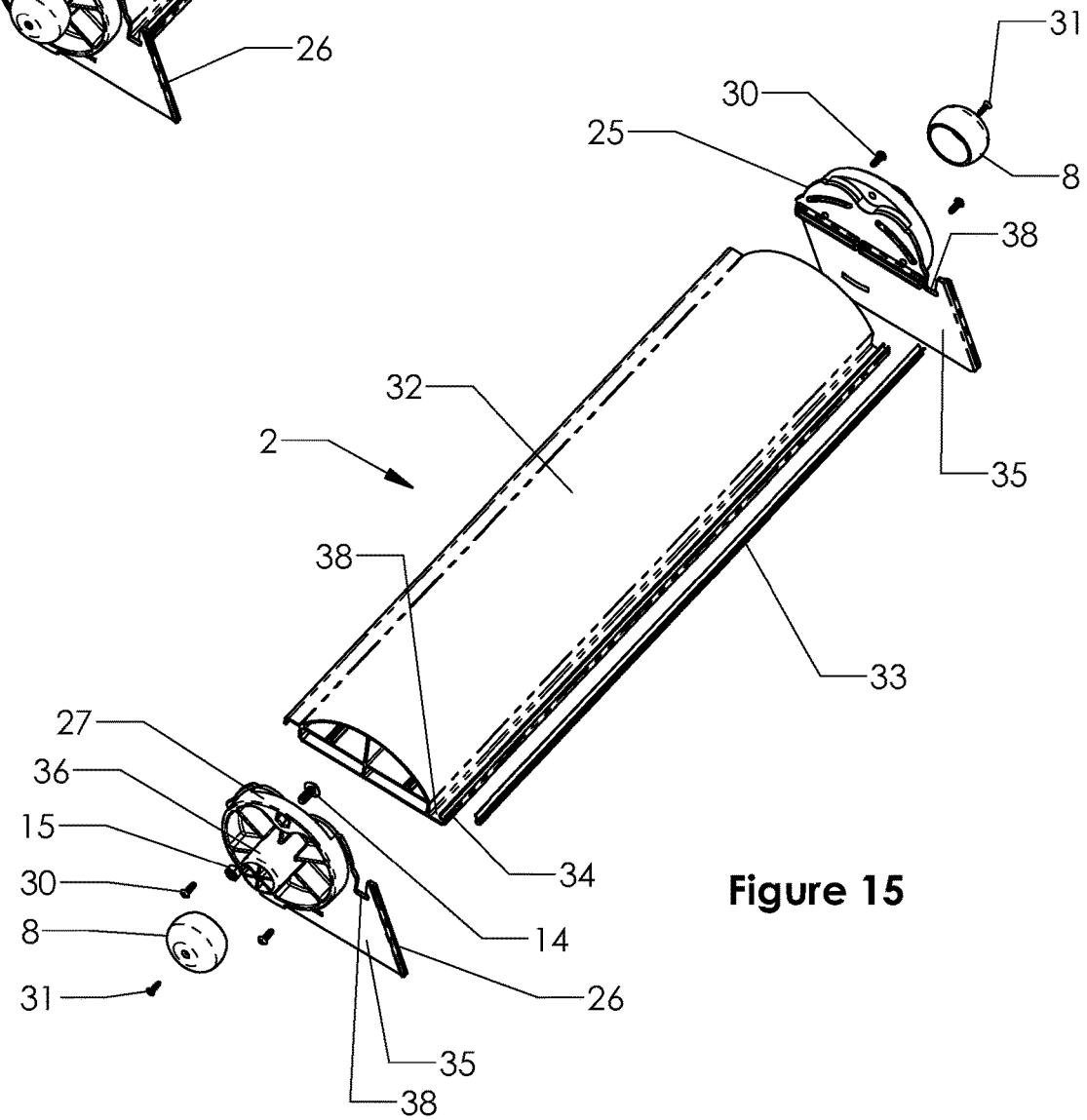
FIG. 15 is an Exploded isometric view of Louver assembly.
Figure 17:
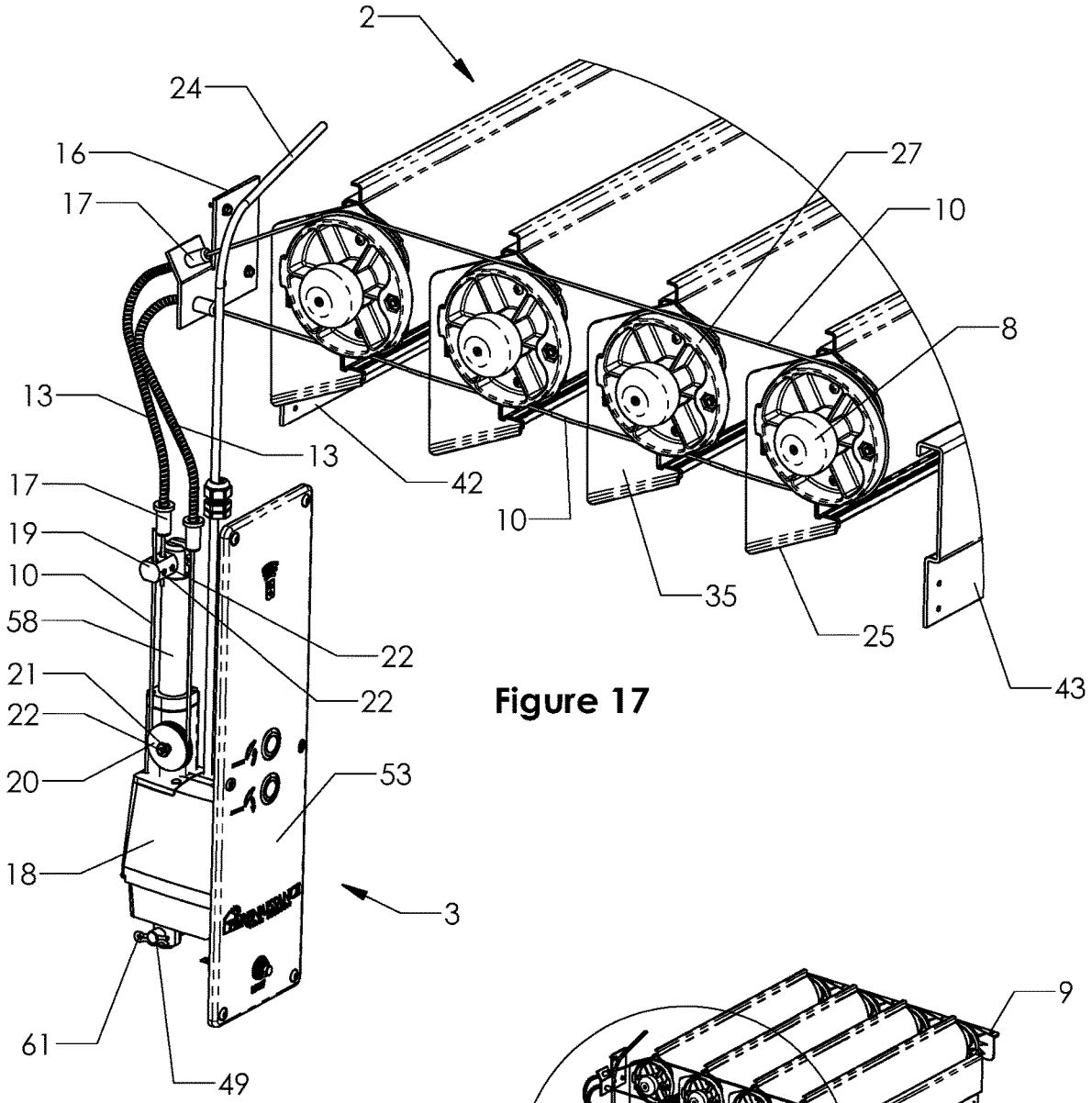
FIG. 17 is a magnified Detail view of FIG. 16.
Figure 16:
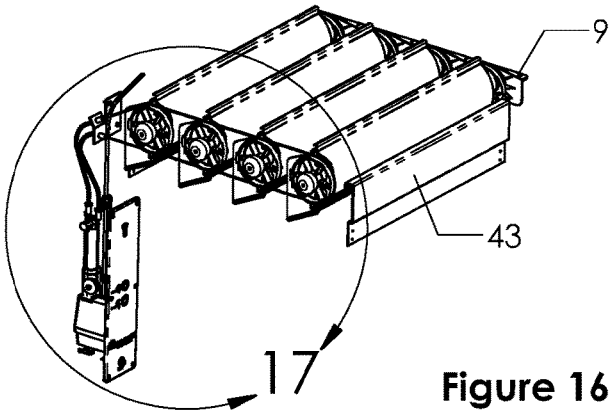
FIG. 16 is another Isometric view of the louver roof assemblies with parts removed for clarity.
Figure 18:
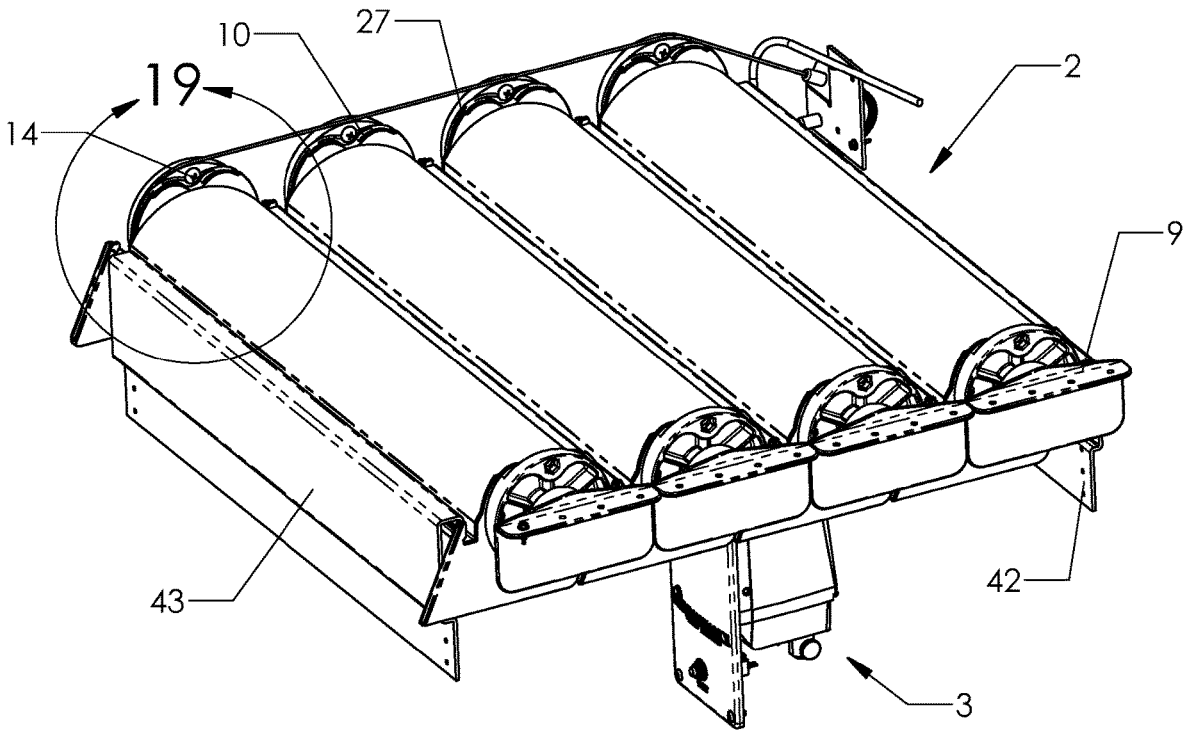
FIG. 18 is another Isometric view of the louver roof assemblies with parts removed for clarity.
Figure 19:
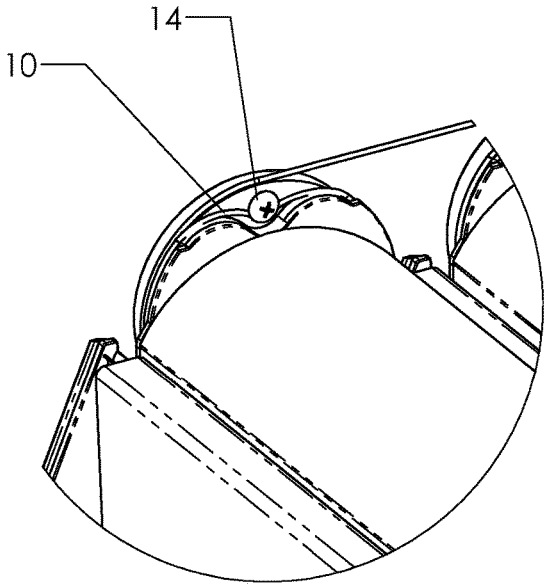
FIG. 19 is a magnified Detail view of FIG. 18.
Figure 20:
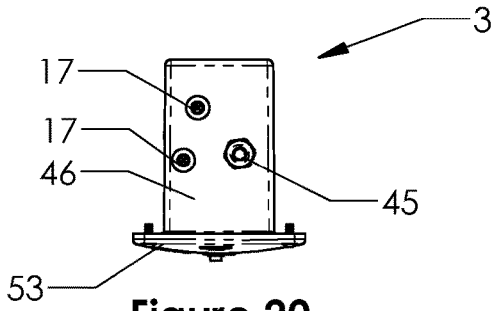
FIG. 20 is a Top view of the control module.
Figure 21:
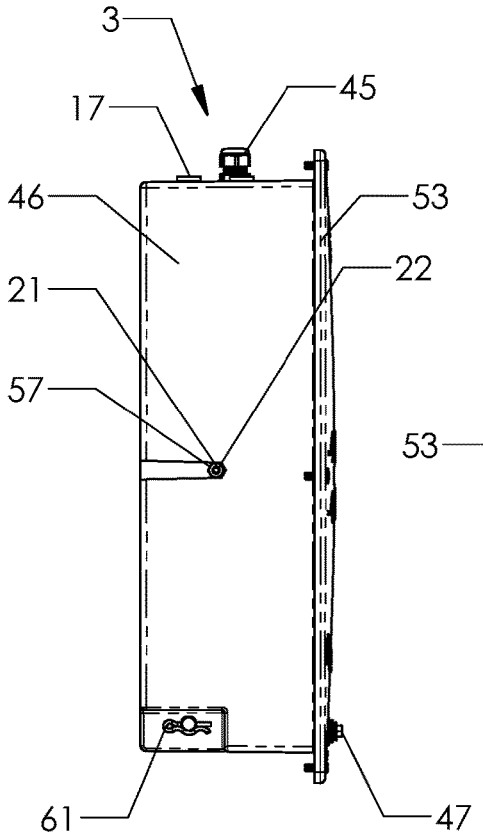
FIG. 21 is a Left side view of the control module.
Figure 22:
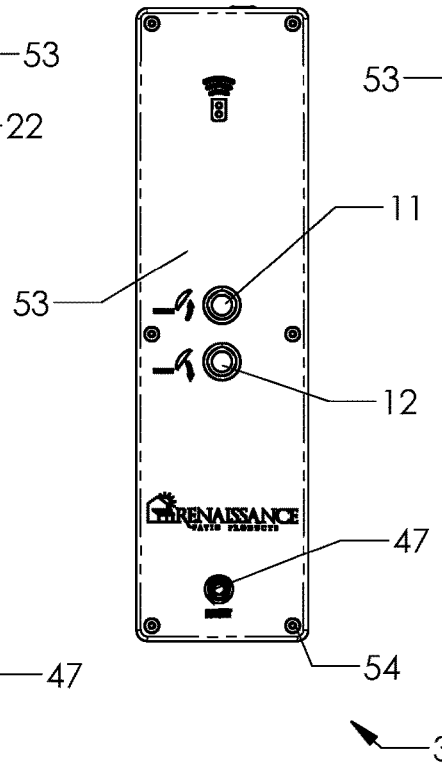
FIG. 22 is a Front view of the control module.
Figure 23:
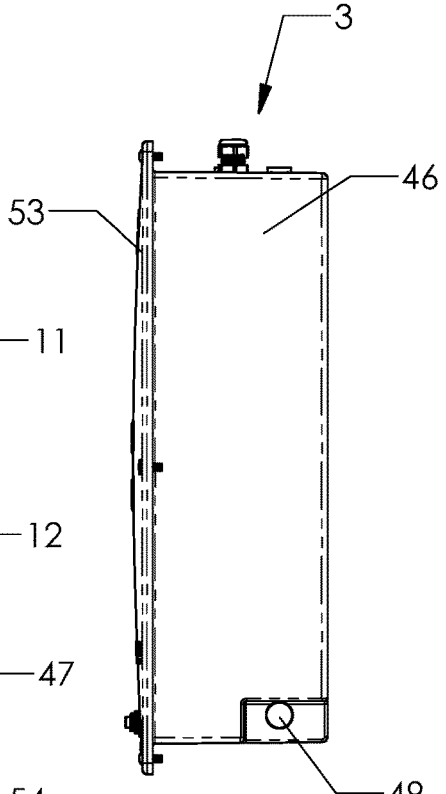
FIG. 23 is a Right side view of the control module.
Figure 24:
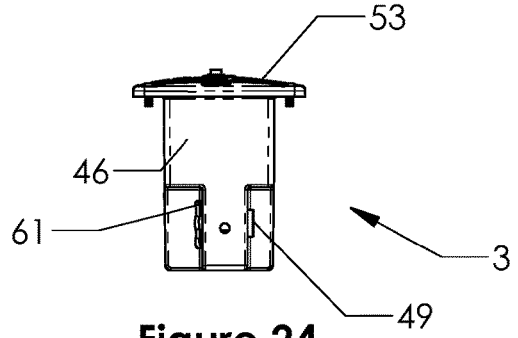
FIG. 24 is a Bottom view of the control module.
Figure 25:
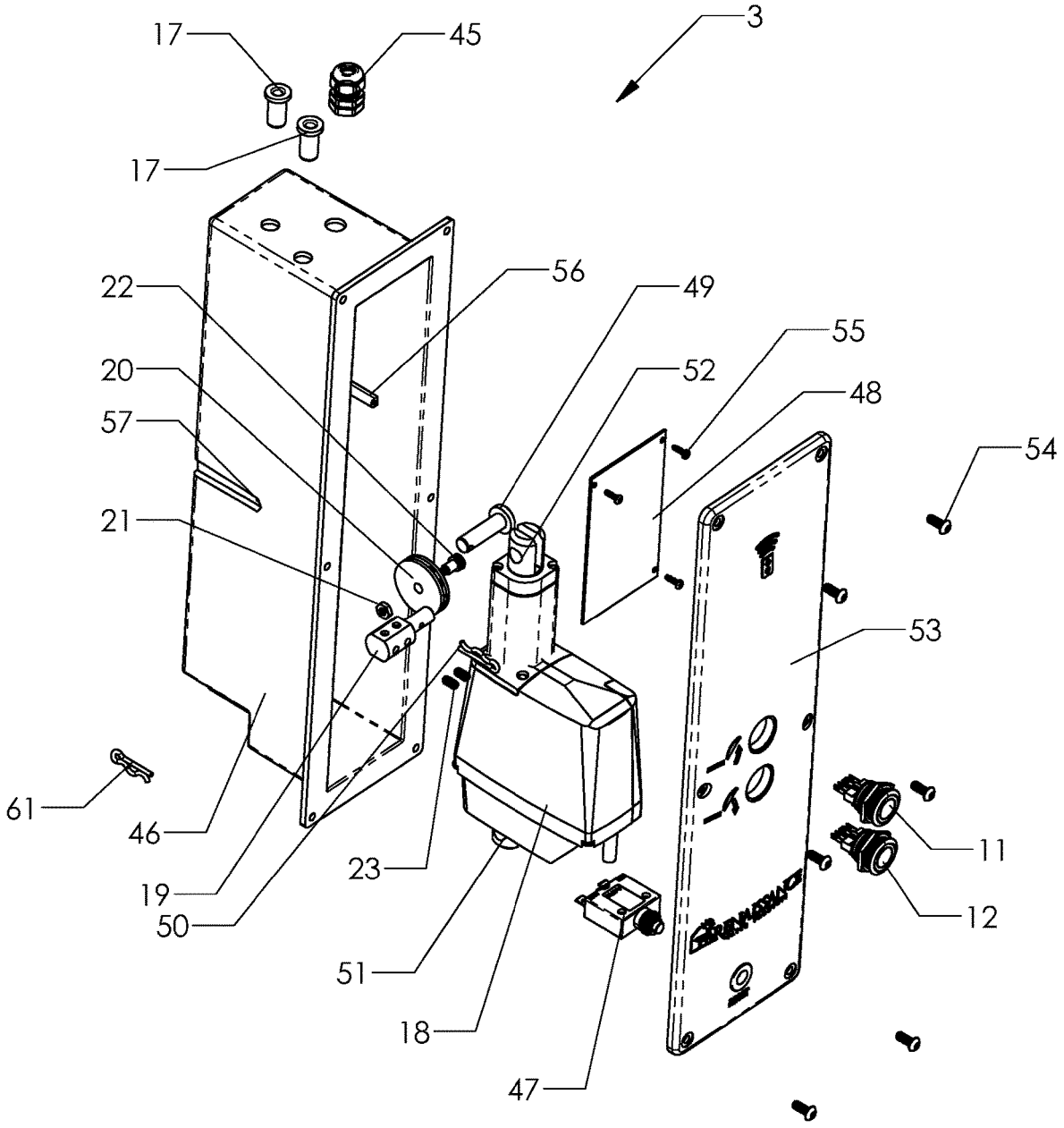
FIG. 25 is an Exploded isometric view of the control module.

Referring to FIGS. 8, 9, 15, 16, 17, 18, 19, 23 and 25, louver assemblies 2 are moved from the open to closed position by cable 10, a stainless-steel wire rope. Cable 10 is routed 1 (one) complete turn, around cable drum 27 and under the head of clamp screw 14 on each louver assembly. Cable drum 27 is an integral part of end cap 26 a part of louver assembly 2. Each end of the cable is routed through sheath retainer 17 on cable retainer plate 16 and cable sheath 13. Cable retainer plate 16 is affixed to the adjacent beam 5. The cable 10 continues through the sheath retainer 17 on drive module 3. One end of the cable 10 is clamped into the cable return clamp 19 in the drive module 3 by means of a cable return clamp screw 23. The other end of the cable is looped around pulley 20 and is clamped into the cable return clamp 19 by means of the other cable return clamp screw 23. Pulley 20 is affixed to the actuator housing 46 by means of pulley retainer screw 22, located in pulley screw aperture 57 on actuator housing 46 and retained by pulley retainer nut 21. This creates a closed cable loop. Referring to FIG. 9, if the cable is pulled to rotate the louver assembly 2 clockwise, the louver is opened. If the cable is pulled opposite, the louver is closed. After the cable is securely fastened at the fully closed position, clamp screw 14 is tightened on each louver in the fully closed position.

To provide power to move the louvers, the cable return clamp 19 is connected to the plunger 58 side of linear actuator 18 by means of inserting cable return clamp 19 into actuator plunger aperture 52 on linear actuator 18 and retaining said clamp with clamp retainer 50. To mount and bias linear actuator 18 to the system, pin 49 placed through linear actuator mounting pin aperture 62 on actuator housing 46, through actuator mounting aperture 51 on linear actuator 18 and retained by pin retainer 61. As the plunger 58 moves in direction 28, the louvers are driven to the open position.

Power for linear actuator 18 is provided by power cable 24 entering the drive module 3 through a bulkhead cable seal 45 on actuator housing 46. Power is controlled and actuator direction is determined by an "H" bridge switch (not shown) on control printed wiring board 48. This board also contains a remote-control receiver and temperature sensor (not shown). Control printed wiring board 48 is mounted in actuator housing 46 by means of a plurality of control model screws 55 secured into control module bosses 56. The louvers can be controlled by radio remote control switch (not shown) or an open pushbutton switch 11 and a close pushbutton switch 12 located on control panel 53. Circuit breaker 47 is also located on control panel 53 as a safety feature. Control panel screws 54 secure the control panel 53 to actuator housing 46 and to one of the posts 4.

Referring to FIGS. 4, 4A, 8, 9, 12, 16, 17, 18, 19 and 26, to prevent water ingress from the open sides of the louvers, lower longitudinal splash shield 42 is affixed to beam 5 by means of a plurality self-tapping screws 6. Lower longitudinal splash shield seal 44 is press fit into seal channel 29, in integral part of lower longitudinal splash shield seal 44. This seal contacts sealing channel 37 when the louvers are in the closed position. On the opposite side of the lover roof, upper longitudinal splash shield 43 is attached to the opposite side beam 5 by means of a plurality of self-tapping screws 6. Louver seal 33 seals against upper longitudinal splash shield 43 when the louvers are in the closed position.

PARTS LIST

1 main structure
2 louver assembly
3 drive module
4 post(s) (vertically oriented posts)
5 beam(s) (crossbeams)
6 self-tapping screw
7 debris/UV cover
8 bearing
9 hanger
10 cable
11 open pushbutton switch
12 close pushbutton switch
13 cable sheath
14 clamp screw
15 clamp screw nut
16 cable retainer plate
17 sheath retainer
18 linear actuator
19 cable return clamp
20 pulley
21 pulley retainer nut
22 pulley retainer screw
23 cable return clamp screw
24 power cable
25 left louver cap
26 right louver cap
27 cable drum
28 open direction
29 seal channel
30 thread forming screw
31 screw
32 louver body
33 louver seal
34 louver seal channel
35 splash skirt
36 bearing boss
37 sealing channel
38 water channel
39 gutter(s) on inner portion of crossbeam(s)
40 downspout in post(s)
41 bezel
42 lower longitudinal splash shield
43 upper longitudinal splash shield
44 lower longitudinal splash shield seal
45 bulkhead cable seal
46 actuator housing
47 circuit breaker
48 control module
49 pin
50 clamp retainer
51 actuator mounting aperture
52 actuator plunger aperture
53 control panel
54 control panel screw
55 control module screw
56 control module boss
57 pulley screw aperture
58 plunger
59 bearing receiver
60 structural wall
61 pin retainer
62 linear actuator mounting pin aperture
63 aperture

What is claimed is:

1. A louver roof structure comprising:

(a) a plurality of louvers positioned within an upper portion of a frame and that are actuatable from an open position to a closed position, wherein each louver of the plurality of louvers includes a louver body defining an integrally formed channel configured to direct water internally from the louver body, through the integrally formed channel of the respective louver, within the frame, and out of the louver roof structure when the plurality of louvers are in the closed position; and (b) the frame including:

(i) vertically oriented posts, with each of the vertically oriented posts having a first end and a second end that are spaced apart from one another with the first end configured to directly contact a surface underneath the louver roof structure and support the louver roof structure thereon, (ii) a plurality of crossbeams, with at least one of the crossbeams positioned between and directly connected to the second end of two of the vertically oriented posts, wherein:

the louver body of each of the louvers includes a top surface with an uppermost portion of the top surface that defines, when in the closed position, a non-perpendicular angle relative to the vertical direction such that water is directed to the integrally formed channel of the respective louver, and the frame includes internal portions configured to receive water from the plurality of channels formed by the plurality of louvers when in the closed position and direct water internally within the louver roof structure through at least one of the crossbeams of the frame internally into at least one of the vertically oriented posts of the frame and out of the louver roof structure via an opening positioned on the first end of the at least one vertically oriented post.

2. The louver roof structure of claim 1, further comprising a debris cover positioned above the upper portion of the frame that is configured to prevent and/or reduce debris from entering into the plurality of louvers to maintain operability of the plurality of louvers.

3. The louver roof structure of claim 2, wherein each louver of the plurality of louvers is connected to one another and configured to actuate in concert from the open position to the closed position and vice versa.

4. The louver roof structure of claim 3, wherein each louver of the plurality of louvers includes a drum that is operably connected to a cable and an actuator.

5. The louver roof structure of claim 4, wherein the actuator is configured to actuate the cable thereby concurrently moving each louver of the plurality of louvers from the open position to the closed position and vice versa.

6. The louver roof structure of claim 5, wherein the actuator is internally positioned and concealed within at least one of the vertically oriented posts.

7. The louver roof structure of claim 6, wherein each of the crossbeams of the frame and each of the vertically oriented posts of the frame includes the internal portions positioned within the louver roof structure that are configured to receive water from the plurality of channels formed by the plurality of louvers when in the closed position that direct water internally within the louver roof structure through at least one of the crossbeams of the frame internally into at least one of the vertically oriented posts of the frame and out of the louver roof structure via the opening positioned on the first end of the at least one vertically oriented post.

8. The louver roof structure of claim 7, wherein the internal portions of each of the crossbeams comprises a gutter formed internally within the louver roof structure on an inner portion of the crossbeam that is configured to receive water from the plurality of channels formed by the plurality of louvers when in a closed position and each of the vertically oriented posts comprises a downspout that is in fluid communication with the gutter formed on the inner portion of at least one of the crossbeam and is configured to direct water through the vertically oriented posts and out of openings positioned on the first end of each of the vertically oriented posts.

9. The louver roof structure of claim 8, further comprising connecting members that connect each of the louvers to the frame that are configured for independent linear movement of each of the louvers relative to one another during and post-installation of the louver roof structure.

10. The louver roof structure of claim 9, wherein the connecting members comprises a cup and ball bearing arrangement.

11. The louver roof structure of claim 10, wherein the connecting members do not allow for independent rotational movement of each of the louvers relative to one another.

12. The louver roof structure of claim 1, wherein the internal portions configured to receive water comprise a gutter formed on an inner portion of the at least one crossbeam and a downspout formed within the at least one vertically oriented post that is in fluid communication with both the gutter formed on an inner portion of the at least one crossbeam and the opening positioned on the first end of the at least one vertically oriented post.

13. The louver roof structure of claim 12, further comprising connecting members that connect each of the louvers to the frame that are configured for independent linear movement of each of the louvers relative to one another during and post-installation of the louver roof structure.

14. The louver roof structure of claim 1, wherein the upper most surface of the top surface of the louver body of each of the louvers extends from a first end to a second end between a first edge and channel edge, along which the integrally formed channel extends, and wherein the first edge is positioned higher in the vertical direction than the channel edge in the closed position such that the upper most surface defines the non-perpendicular angle.

15. The louver roof structure of claim 14, wherein the uppermost portion of the top surface of the louver body of each of the louvers defines, when in the closed position, a convex shape relative to the vertical direction from the first edge to the channel edge in cross-section.

16. The louver roof structure of claim 1, wherein the top surface of the louver body of each of the louvers is a semi-cylindrical shape, when viewed in cross-section, and extends along a longitudinal direction from a first end to a second end and extends along a spanwise direction from a first edge to a channel edge.

17. The louver roof structure of claim 16, wherein an apex of the semi-cylindrical shaped top surface defined by the louver body of each of the louvers is positioned mid-span between the first edge and the second edge.

18. The louver roof structure of claim 16, wherein the top surface of the louver body of each of the louvers defines a variable slope from the first edge to the channel edge in cross-section, and wherein the louver body of each of the louvers further includes an inner channel wall extending longitudinally along the channel edge of the respective louver body, the inner channel wall configured to extend, when in the closed position, along the vertical direction between the channel edge and a bottom of the integrally formed channel of the respective louver body.

19. The louver roof structure of claim 16, wherein a vertical distance between the first edge and the channel edge of the top surface of the louver body of each of the louvers defines a first height difference, when in the closed position, and wherein, in the open position, the vertical distance between the first edge and the channel edge of the top surface of the louver body of each of the louvers defines a second height difference, the second height difference greater than the first height difference.

20. A louver roof structure comprising:

(a) a plurality of louvers positioned within an upper portion of a frame and that are actuatable from an open position to a closed position, wherein each louver of the plurality of louvers forms a channel along a longitudinal direction of the louver and is configured to direct water internally within the frame and out of the louver roof structure when the plurality of louvers are in the closed position; and (b) the frame including:

(i) vertically oriented posts, with each of the vertically oriented posts having a first end and a second end that are spaced apart from one another with the first end configured to directly contact a surface underneath the louver roof structure and support the louver roof structure thereon, (ii) a plurality of crossbeams, with at least one of the crossbeams positioned between and directly connected to the second end of two of the vertically oriented posts, and (iii) a vertically oriented splash shield affixed to one of the crossbeams and extending along the longitudinal axis of a first sequential louver of the plurality of louvers, wherein:

the vertically oriented splash shield and the first sequential louver are configured to selectively produce a seal therebetween when the first sequential louver is in the closed position, and wherein the frame includes internal portions configured to receive water from the plurality of channels formed by the plurality of louvers when in the closed position and direct water internally within the louver roof structure through at least one of the crossbeams of the frame internally into at least one of the vertically oriented posts of the frame and out of the louver roof structure via an opening positioned on the first end of the at least one vertically oriented post.

21. A louver roof assembly comprising:

(a) a plurality of louvers configured for positioning within an upper portion of a frame that are actuatable from an open position to a closed position, wherein each louver of the plurality of louvers includes a louver body defining an integrally formed channel configured to direct water internally from the louver body, through the integrally formed channel of the respective louver, within the frame, and out of the louver roof structure when the plurality of louvers are in the closed position; and (b) the frame including:

(i) vertically oriented posts, with each of the vertically oriented posts having a first end and a second end that are spaced apart from one another with the first end configured to directly contact a surface underneath the louver roof structure and support the louver roof structure thereon, (ii) a plurality of crossbeams, with each of the crossbeams configured for positioning between and directly connected to the second end of two of the vertically oriented posts, wherein:

the louver body of each of the louvers includes a top surface with an uppermost portion of the top surface that defines, when in the closed position, a non-perpendicular angle relative to the vertical direction such that water is directed to the integrally formed channel of the respective louver, and the frame includes internal portions configured to receive water from the plurality of channels formed by the plurality of louvers when in the closed position and direct water through at least one of the crossbeams of the frame internally into at least one of the vertically oriented posts of the frame and out of the louver roof structure via an opening positioned on the first end of the at least one vertically oriented post.

22. The louver roof assembly of claim 21, further comprising a debris cover that is configured for positioning above the upper portion of the frame to prevent and/or reduce debris from entering into the plurality of louvers to maintain operability of the plurality of louvers when the louver roof assembly is assembled.

23. The louver roof assembly of claim 22, wherein each louver of the plurality louvers are connected to one another and are configured to actuate in concert from an open position to the closed position and vice versa.

24. The louver roof assembly of claim 23, wherein the internal portions configured to receive water comprise a gutter formed on an inner portion of the at least one crossbeam and a downspout formed within the at least one vertically oriented post that is in fluid communication with both the gutter formed on an inner portion of the at least one crossbeam and the opening positioned on the first end of the at least one vertically oriented post.

* * * * *